US009950837B2

(12) United States Patent
Foster

(10) Patent No.: US 9,950,837 B2
(45) **Date of Patent: *Apr. 24, 2018**

(54) BOTTLE

(71) Applicant: Samuel Foster, Devon, PA (US)

(72) Inventor: Samuel Foster, Devon, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/220,904

(22) Filed: Jul. 27, 2016

(65) Prior Publication Data

US 2017/0001758 A1 Jan. 5, 2017

Related U.S. Application Data

(63) Continuation of application No. 13/492,183, filed on Jun. 8, 2012, now Pat. No. 9,428,303.

(51) Int. Cl.

| | |
|---|---|
| ***B65D 23/12*** | (2006.01) |
| ***B65D 1/02*** | (2006.01) |
| *B65D 21/02* | (2006.01) |
| *B65D 69/00* | (2006.01) |

(52) U.S. Cl.

CPC ..... *B65D 23/12* (2013.01); *B65D 1/0284* (2013.01); *B65D 21/0204* (2013.01); *B65D 69/00* (2013.01)

(58) Field of Classification Search

CPC ..... B65D 23/12; B65D 1/0284; B65D 69/00; B65D 21/0204

USPC ..... 206/223, 23.83, 23.86; 215/377, 376, 215/378, 370, 390, 387, 386, 6, DIG. 7; 220/23.83, 23.86

See application file for complete search history.

(56) References Cited

U.S. PATENT DOCUMENTS

| | | | |
|---|---|---|---|
| 2,374,092 | A | 8/1942 | Glaser |
| 4,040,538 | A | 8/1977 | Gerson |
| 4,416,381 | A | 11/1983 | Swartwout |
| 4,444,324 | A | 4/1984 | Grenell |
| 4,620,330 | A | 11/1986 | Izzi, Sr. |
| 4,976,299 | A | 12/1990 | Bickelman |
| 5,036,446 | A | 7/1991 | Quintanilla et al. |
| 5,040,719 | A | 8/1991 | Ballway |
| 51,800,079 | | 1/1993 | Jeng |
| 5,244,106 | A | 9/1993 | Takacs |
| 5,301,833 | A | 4/1994 | Aycan |
| 5,402,907 | A | 4/1995 | Liu |
| 7,404,345 | B1 | 7/2008 | Dipprey |
| 7,789,255 | B2 | 9/2010 | Zoppas |

(Continued)

FOREIGN PATENT DOCUMENTS

WO 2005009849 A1 2/2005

*Primary Examiner* — King M Chu
*Assistant Examiner* — James M Van Buskirk
(74) *Attorney, Agent, or Firm* — Barley Snyder

(57) ABSTRACT

A bottle that includes adaptive measuring equipment. The bottle having a container and a measuring receptacle. The container includes a securing device secured thereto and includes a device base, a fitting member and a receiving chamber. The device base includes a securing mechanism receiving passageway extending there through. The fitting member extends from the device base, while the receiving chamber is accessible through the securing mechanism receiving passageway and positioned within inner walls of the fitting member. The measuring receptacle includes a receptacle base, a side wall extending from an upper surface of the receptacle base, and a securing mechanism extending upward from the upper surface of the receptacle base and passing through the securing mechanism receiving passageway.

18 Claims, 8 Drawing Sheets

(56) References Cited

U.S. PATENT DOCUMENTS

| | | | |
|---|---|---|---|
| 8,002,129 | B1 | 8/2011 | Reyes |
| 2002/0040883 | A1 | 4/2002 | Ciesla |
| 2008/0011710 | A1 | 1/2008 | Cohn |
| 2008/0116164 | A1 | 5/2008 | Dellinger et al. |
| 2009/0193890 | A1 | 8/2009 | Mentesh |
| 2011/0049167 | A1 | 3/2011 | Martin et al. |

BOTTLE

CROSS-REFERENCE TO RELATED APPLICATIONS

This application is a continuation of U.S. patent application Ser. No. 13/492,183, filed Jun. 8, 2012, claiming priority under 35 U.S.C. § 119.

FIELD OF THE INVENTION

The invention relates to a bottle and, more particularly, to a bottle having adaptive measuring equipment.

BRIEF DESCRIPTION OF THE DRAWINGS

The invention will be explained in greater detail with reference to embodiments, referring to the appended drawings, in which.

DETAILED DESCRIPTION OF THE EMBODIMENT(S)

Figure 1:
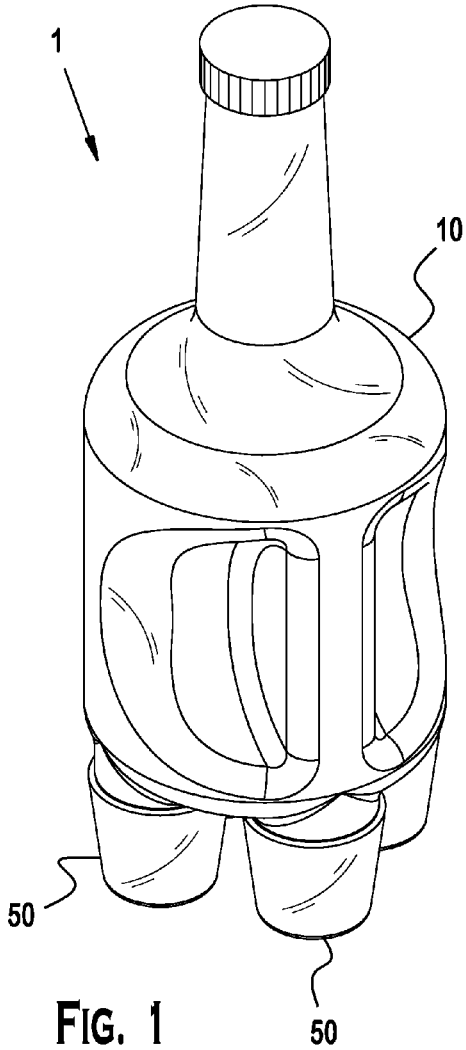
FIG. 1 is a perspective of a bottle.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Hereinafter, a disclosure of a bottle 1 will be described with reference to the appended figures.

Figure 2:
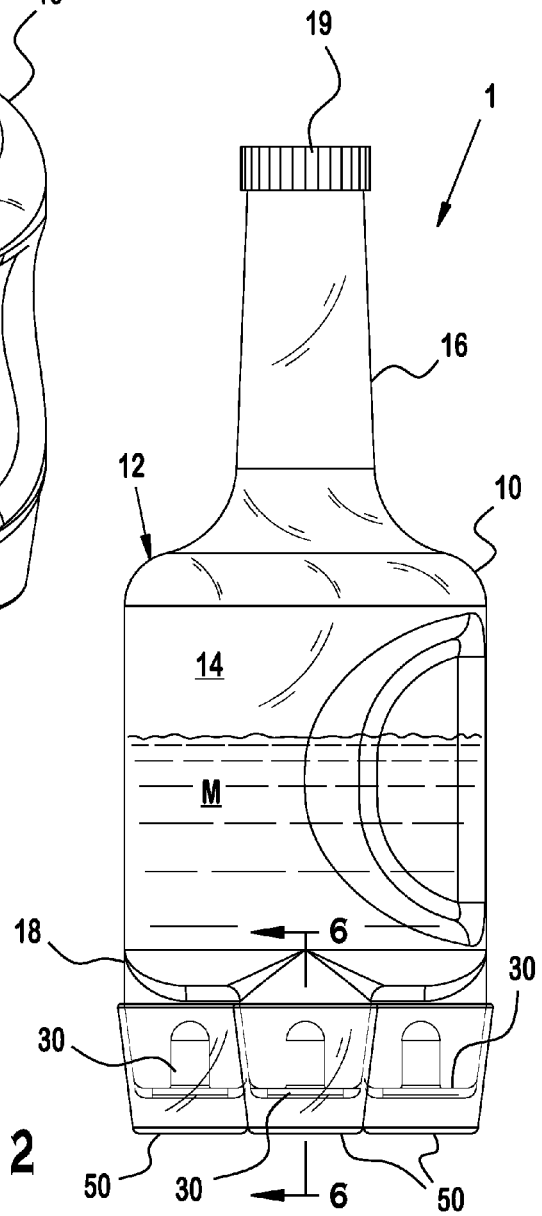
FIG. 2 is a side view of the bottle shown in FIG. 1.

Referring first to FIGS. 1 and 2, the bottle 1 includes the following components: a container 10, a plurality of securing devices 30, and a plurality of measuring receptacles 50. In the embodiment shown, the container 10 receives the plurality of securing devices 30, which rotate to secure the plurality of measuring receptacles 50 to the container 10. Now each component will be further described.

As shown in FIGS. 1-3 and 6, the container 10 is a bottle-type container having a body 12 and an inner compartment 14. In an exemplary embodiment, the body 12 includes thinned walls of plastic or glass that form the inner compartment 14 into which a material M, such as a liquid or particulate, is held. The body 12 further includes a neck 16 positioned at one end of the body 12 and a base 18 at another end thereof, which is traditionally used to support the body 12. The body 12 further includes an opening and a passageway that leads from the neck 16 into the inner compartment 14. A cap 19 may be used to close the opening and entrap any material M positioned in the inner compartment 14.

The body 12 generally has a substantially cylindrical shape with a screw threaded profile around the neck 16 so that the cap 19 can be removably secured to the body 12.

Figure 3:
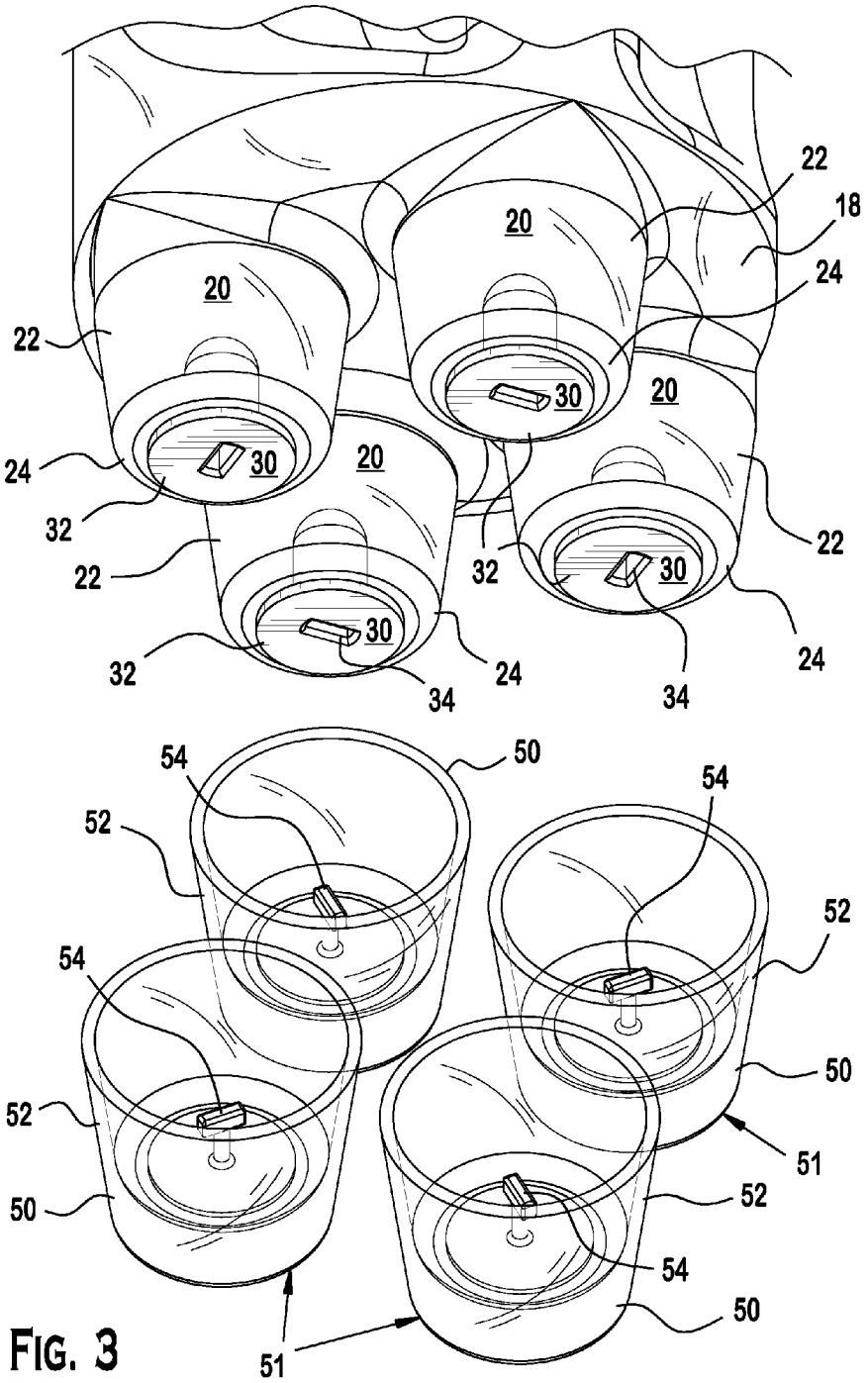
FIG. 3 is a bottom perspective view of a container, a plurality of securing devices, and a plurality of measuring receptacles according to the bottle shown in FIG. 1.

With reference to FIG. 3, the container 10 further includes a self supporting base structure having a plurality of projections 20, which are integral with the body 12. In the embodiment shown, four projections 20 extend from the base 18 of the body 12. Each projection 20 includes an exterior wall 22, a support 24, and a recess 26. The exterior wall 22 extends from the base 18 and connects to the support 24. The support 24 is generally planar. In the embodiment shown, the exterior wall 22 is circular. However, it is possible that the another polygonal shape be utilized, and the skilled artisan would appreciate that each projection is not limited to a particular shape or size. In fact, multiple projections may have different sizes and shapes to accommodate different sizes and shapes of the measuring receptacles 50.

In the embodiment shown, the self supporting base structure results from each of the projections having a planar bottom surface since the supports 24 are flat, parallel, and planar to each other. As a result, when the container 10 is positioned on table or counter, the container 10 is self supporting. However, it is also possible that each projection 20 has a slightly hemispherical shape, between the exterior walls 22 and the support 24. In this case, it is also possible that the container 10 can be self supporting.

Figures 4, 5:
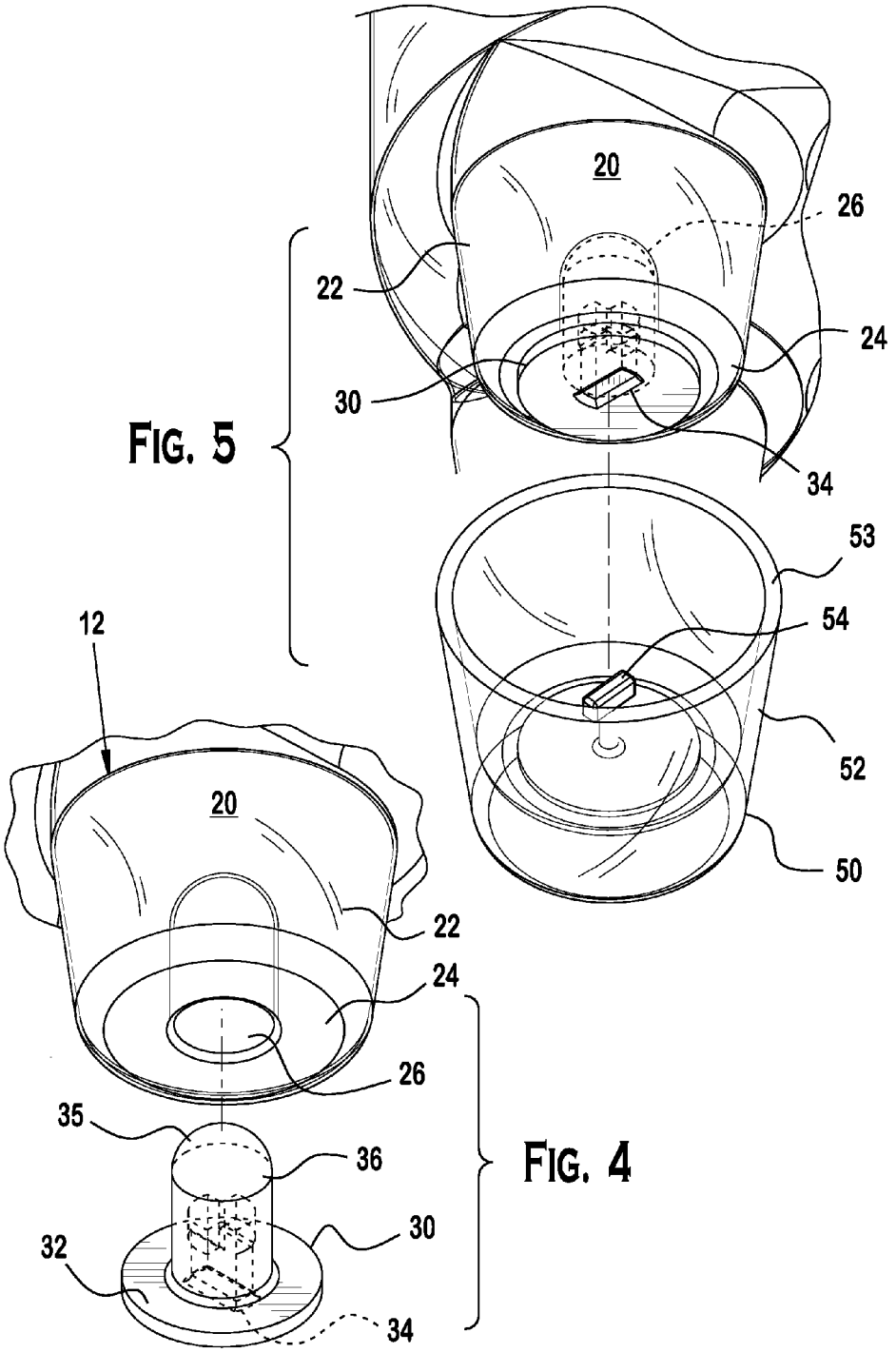
FIG. 4 is a close up bottom view of a projection having a securing device recess to receive one of the plurality of securing devices of the bottle.
FIG. 5 is a close up perspective view of the projection of the container to which one of the plurality of securing devices and one of the plurality of removable measuring receptacles is secured.

As shown FIGS. 4 and 5, the projection 20 is shown, having a recess 26 extending from the support 24. The recess 26 is a cavity having supporting walls that extend into the body 12 to form the cavity. In the embodiment shown, the supporting walls are cylindrical, starting from support and extending to a domed end section, which is keyed to match the shape of a securing device 30 (which will be described later). However, it is possible that other polygonal shapes may be utilized, and the skilled artisan would appreciate that each recess 26 have is not limited to a particular shape or size. In fact, multiple the recess 26 have may have different sizes and shapes to accommodate different sizes and shapes of the securing device 30. The securing device 30 is adapted to communicate with recess 26 such that the securing device 30 is snug fit with the supporting walls of the recess 26.

Figure 6:
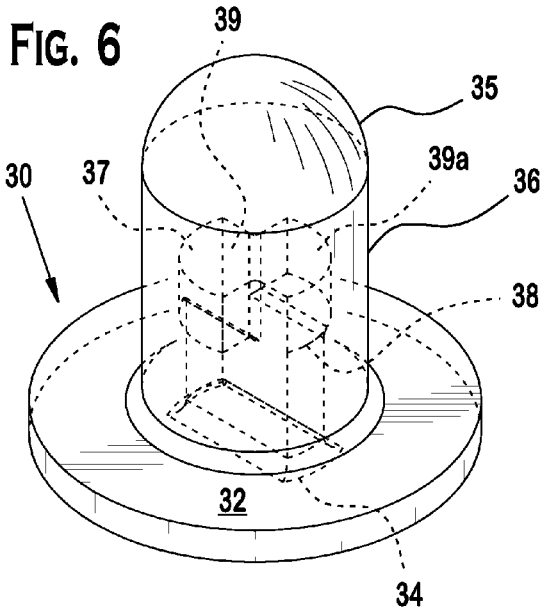
FIG. 6 is a perspective view of a securing receptacle of the bottle.
Figure 7:
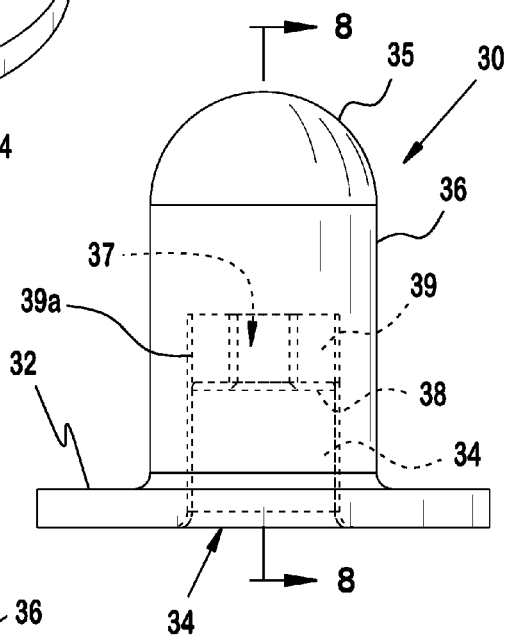
FIG. 7 is a side view of the securing receptacle shown in FIG. 6.
Figure 8:
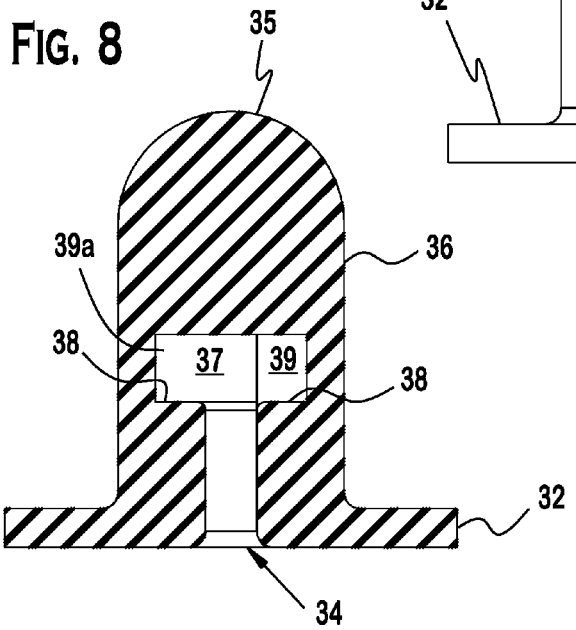
FIG. 8 is a sectional side view of the securing receptacle shown in FIG. 7.

As shown, in FIGS. 6 through 8, the securing device 30 includes a base 32, a receiving passageway 34, and a fitting member 36. The base 32 is a flat planar surface, with the fitting member 36 extending from the base 32. In the embodiment shown, the fitting member 36 is an elongated hollow member, extending from the base 32 and has a hemispherical crown wall 35. However, in the shown embodiment it is shaped to fit the recess 26. Nevertheless, the shape and dimensions of the fitting member can be modified such that the fitting member 36 is adapted to the shape and dimensions of the recess 26. The receiving passageway 34 is a slot extending through the base 32 and into the fitting member 36. The receiving passageway 34 is sized to receive the securing mechanism 54 such that the securing mechanism 54 can freely pass through the base 32 and into the fitting member 36.

In general, the securing device 30 is keyed shaped to snug fit with the recess 26. In particular, in the embodiment shown, fitting member 36 bias the supporting walls of the recess 26 when the fitting member 36 is positioned in the recess 26, and the base 32 sits flush with the support 24 (see FIG. 5).

The fitting member 36 includes a receiving chamber 37 within the fitting member 36 and is accessible through the receiving passageway 34, a retaining wall 38, and a stop 39. The receiving chamber 37 is a cavity within the fitting member 36, which is bound by the retaining wall 38, the stop 39, and inner walls 39*a* (i.e. body of the fitting member 36. In the embodiment shown, the receiving chamber 37 has a width that is equal to or larger than the receiving passageway 34 that extends from the base 32 through the fitting member 36 and into receiving chamber 37. In general, the receiving chamber 37 is shaped and sized to accommodate the securing mechanism 54. The retaining wall 38 is part of the body of the fitting member 36, and is a horizontal support in the receiving chamber 37 surrounding the receiving passageway 34. The stop 39 is also part of the body of the fitting member 36. The stop 39 is a vertical support wall that extends from the retaining wall 38 and extends laterally from the inner walls 39*a* into the receiving chamber 37 and toward the receiving passageway 34; such that the stop 39 can limit rotation of the securing mechanism 54 when the securing mechanism is positioned in the receiving chamber 37. In the embodiment shown, there are two stops 39 positioned within the receiving chamber 37.

In the embodiment shown, for example, in FIG. 8, the receiving chamber 37 does not extend to the crown wall 35, so the receiving chamber 37 is wholly contained in the fitting member 36, in the embodiment shown.

Figure 17:
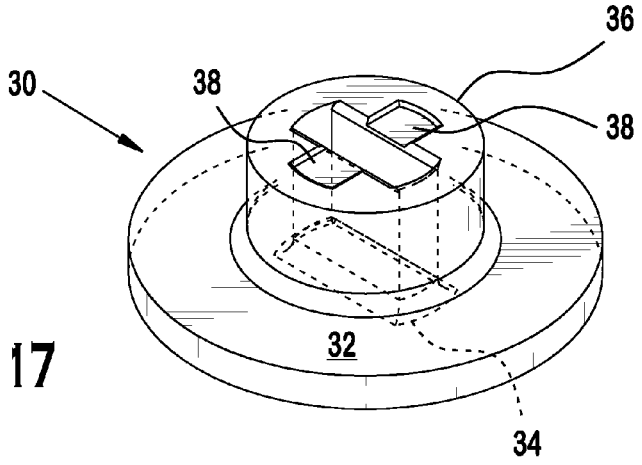
FIG. 17 is a perspective view of a securing device according to the invention.

In another embodiment, shown in FIG. 17, it is possible that fitting member 36 does not include the receiving chamber 37. Rather, the receiving passageway 34 extends completely through the fitting member 36, and the retaining wall 38 is positioned just below a horizontal top surface of the fitting member 36. The retaining wall 38 is a type of detent system that prevents movement of the securing mechanism 54 when positioned through the receiving passageway 34. Therefore, the fitting member 36 includes a flat planar upper surface with a protuberance(s) or a divot(s) that acts like a catch.

In the embodiment shown, the securing device 30 is made of plastic, such as rubber, and formed with mating surfaces, shaped to match internal surfaces of the recess 26. The fitting member 36 frictionally engages the securing device 30 with the recess 26, since the fitting member 36, in the embodiment shown, is elastically deformable and sized slightly larger than then recess 26. Therefore, when the fitting member 36 is positioned in the recess 26, the fitting member 36 is snug fit with the container 10. The fitting member 36 elastically deforms to first fit within the recess 26 and then biases the walls of the recess 26 to secure the securing device 30 with the container 10.

If the securing device 30 is elastically deformable, then it is also possible to use an adhesive to secure the fitting member 36 in the recess 26. In addition, it is also possible in other exemplary embodiments that the structural elements of the securing device 30 are incorporated into the projection 20. For instance, the receiving passageway 34 and the retaining wall 38 may be incorporated into an integral design of the projection 20.

As shown in FIG. 5, the measuring receptacle 50 includes a base 51, a securing mechanism 54 positioned on the base 51, and a side wall 52 extending from the base 51 and surrounding the securing mechanism 54. In the embodiment shown, the side wall 52 is circular in cross-section, sloping downward from a lip 53 to the base 51, and takes shape and dimensions of a known shot glass. However, the measuring receptacle 50 includes a securing mechanism 54 either integrally formed with or secured to the base 51.

Figure 9:
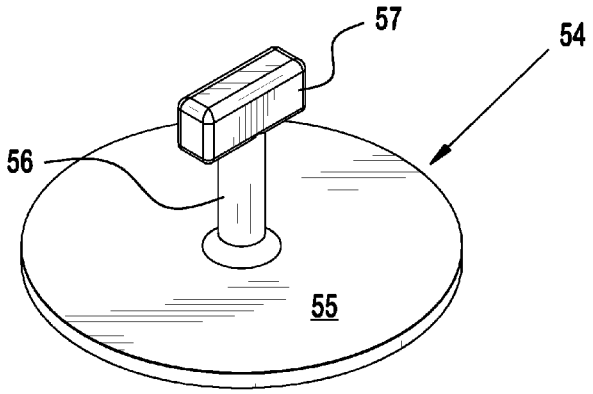
FIG. 9 is a perspective view of a securing mechanism of a removable measuring receptacle.
Figure 10:
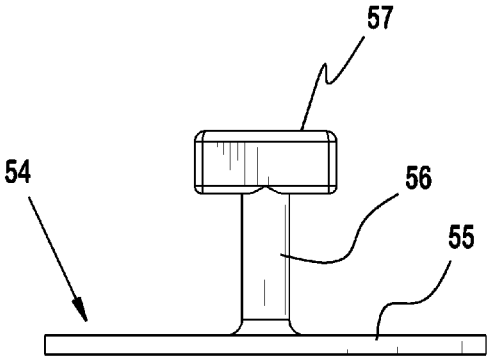
FIG. 10 is a side view of the securing mechanism shown in FIG. 9.
Figure 11:
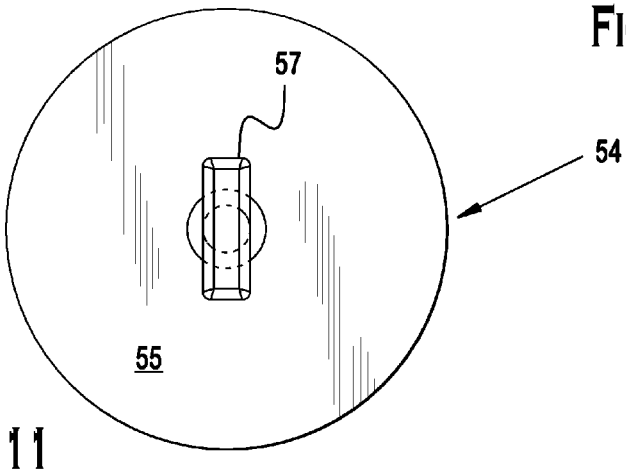
FIG. 11 is a top view of the securing mechanism shown in FIG. 10.

With reference to FIGS. 9 through 11, the securing mechanism 54 is shown, which includes a connection member 55, an extension 56, and a retaining member 57.

In the embodiment shown, the connection member 55 is a planar element connecting the securing mechanism 54 to the base 51. The extension 56 is an elongated member extending from the connection member 55 to the retaining member 57, and provides a set distance between the connection member 55 and the retaining member However, in other embodiments, it is possible that the connection member 55 may be omitted and the extension 56 connects directly to the base 51.

The extension 56 and the retaining member 57 in the embodiment shown are generally circular shaped shaft members that orthogonally connect with each other. However, the shape and the angle at which the two elements connect are not limited to this. Rather, the shown extension 56 and retaining member 57 are just one possible configuration, and a combination of elements may be designed to key with the securing device 30 in order to secure the measuring receptacle 50 and the container 10. The extension 56 and the retaining member 57 are dimensioned to fit into and through the receiving passageway 34, such that a length $L_e$ of the extension 56 is equal to or longer than a length $L_r$ of the receiving passageway 34. Therefore, the retaining member 57 may be positioned just above the retaining wall 38 when the extension 56 and the retaining member 57 are fitted through the receiving passageway 34. Since the securing device 30 is made from an elastically deformable material, such as rubber, the length $L_e$ of the extension 56 may be less than the length $L_r$ of the receiving passageway 34, and the difference in length $L_e$ of the extension 56 and the length $L_r$ of the receiving passageway 34 may be made up by deformation of the elastically deformable securing device 30.

Additionally, a width $W_m$ of the retaining member 57 is at least less than a width $W_c$ of the receiving chamber 37, such that the retaining member 57 can freely rotate in the shown embodiment.

In the embodiment shown, the side wall 52 and the base 51 are dimensioned and shaped such that the measuring receptacle 50 conforms and fits snug with the projection 20 when the securing mechanism 54 is fitted and secured to the securing device 30.

Figure 14:
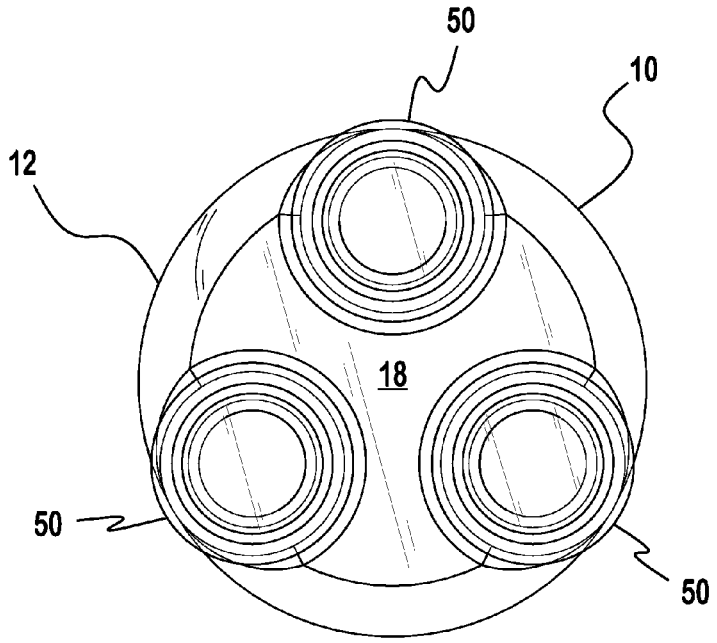
FIG. 14 is a bottom view of another bottle.
Figure 15:
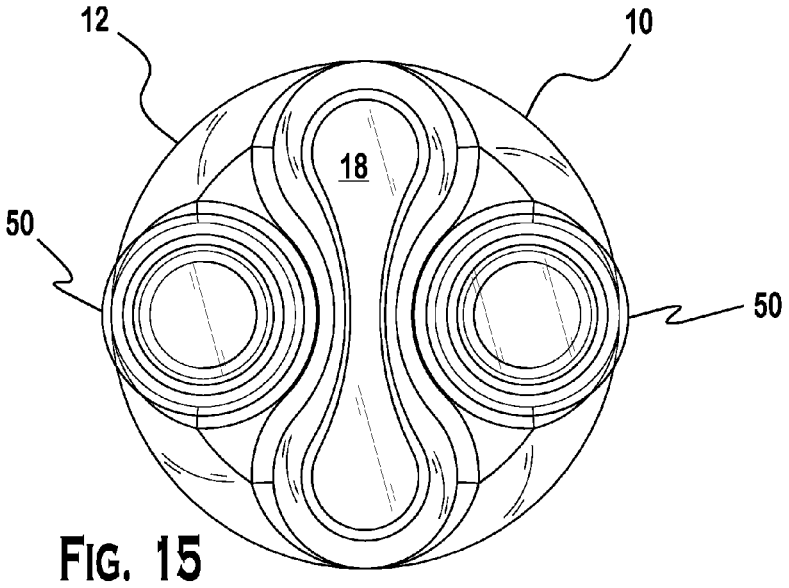
FIG. 15 is a bottom view of another bottle.
Figure 16:
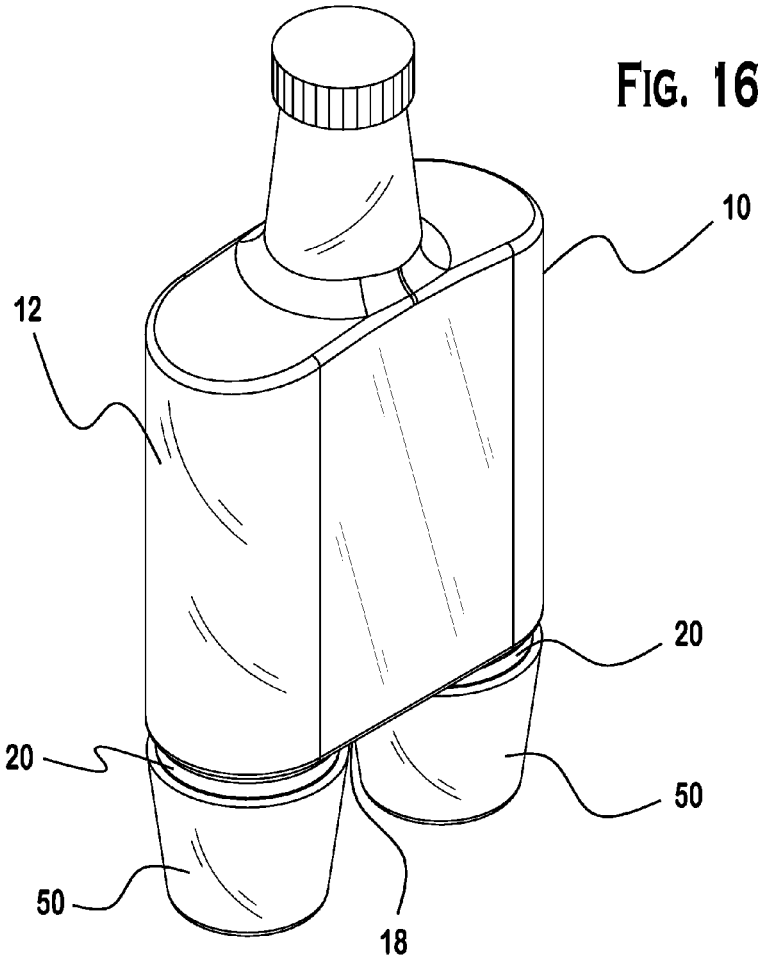
FIG. 16 is a perspective view of another bottle with a plurality of projections to which adaptive measuring receptacles are secured.

Now with reference to FIGS. 14 through 16, several embodiments of the bottle 1 are shown. In particular, various shapes and numbers of projections 20, securing devices 30, and measuring receptacles 50 are provided in the different embodiments.

Figure 12:
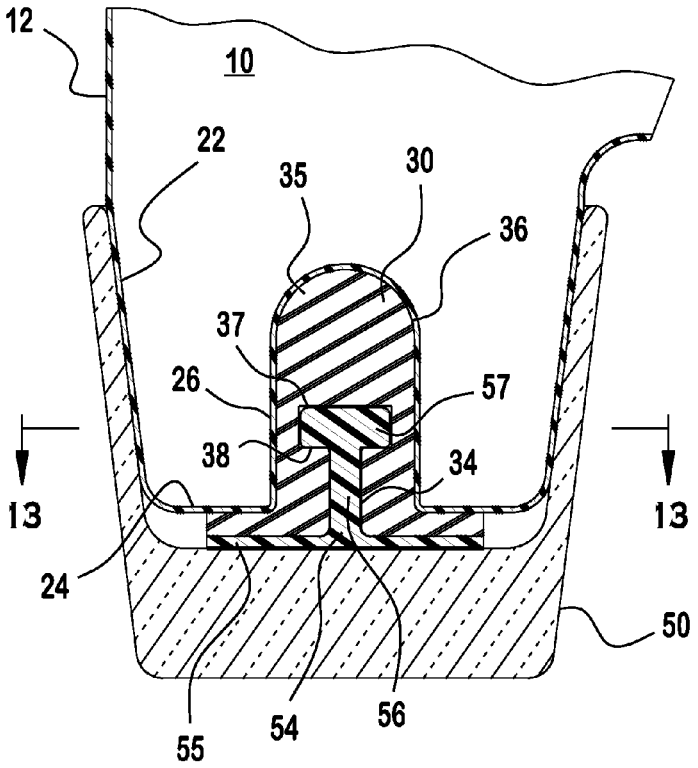
FIG. 12 is a sectional side view of an assembly of the container, the securing device, and the removable measuring receptacle of the bottle shown in FIG. 1.
Figure 13:
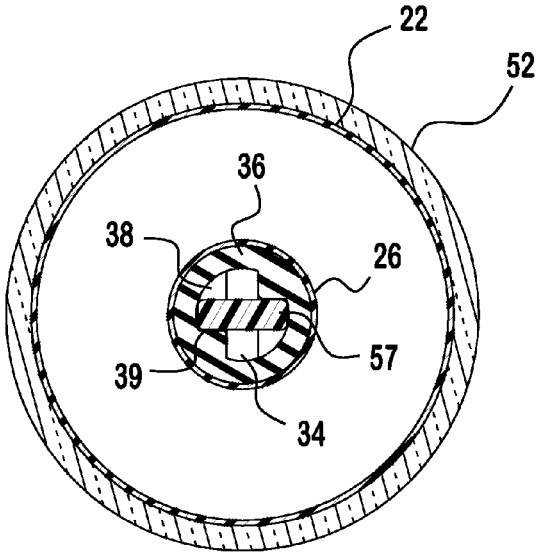
FIG. 13 is a sectional top view of the container, the securing device, and the removable measuring receptacle shown in FIG. 12.

Now with reference to FIGS. 12 and 13, a discussion on how the container 10, the plurality of securing devices 30, and the plurality of measuring receptacles 50 connect together to provide an assembled bottle 1 will be discussed.

As discussed above, the container 10 includes one or more projections 20 having the recess 26. The securing device 30 is fitted into the recess 26, and then secured either by friction fit or by adhesive. Other known ways to secure the securing device 30 in the recess 26 may be used, including multi-shot molding or fastening mechanisms. It is also possible that the structural elements of the disclosed securing device 30, include the receiving passageway 34, receiving chamber 37, retaining wall 38, and stop 39 are included into an integrated design of the projection 20.

In the embodiment shown, the retaining member 57 is inserted into the receiving passageway 34. The extension 56 and the retaining member 57 fit through the receiving passageway 34. Therefore, the retaining member 57 may be positioned just above the retaining wall 38 when the extension 56 and the retaining member 57 are fitted through the receiving passageway 34. Accordingly, when the measuring receptacle 50 is pressed against the securing device 30, in the embodiment shown, the securing device 30 is elastically deformed and allows the retaining member 57 to enter the receiving chamber 37.

Once the retaining member 57 is positioned above a top surface of the retaining wall 38, the retaining member 57 is rotated until it is restricted from doing so by the stop 39, which is a wall orthogonal to the top surface of the retaining wall 38 in the embodiment shown. Now, the retaining member 57 abuts the top surface of the retaining wall 38 and the stop 39. The retaining member 57, and notably the measuring receptacle 50, is secured to the container 10.

If the fitting member 36 does not include a receiving chamber (see FIG. 17), then the retaining member 57 may be rotated until it is restricted from doing so by the retaining wall 38 shaped like a detent system that prevents movement of the securing mechanism 54.

Now, the retaining member 57 abuts the top surface of the retaining wall 38 and the stop 39. The retaining member 57, and notably the measuring receptacle 50, is secured to the container 10.

Since the securing device 30 is made of an elastic material, in the embodiment shown, the securing device 30 fits snug between the measuring receptacle 50 and the projection 20 of the container 10, with little movement or play.

When the bottle 1 is placed on a support surface, such as a table or furniture, the measuring receptacle 50 supports the bottle 1 upright, so the bottle 1 cannot fall over. However, the bottle 1 is fully capable of supporting itself, either using the projections 20 or when the projections 20 are assembled with the securing devices 30.

The shape and configuration of the container 10, securing device 30, and measuring receptacle 50 are not limited to that which is shown. Other configurations are possible, including types of connection mechanism used to secure the aforementioned elements function type and position on where each of the elements are assembled.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A bottle comprising:

a container with a securing device secured thereto, the securing device having:

a device base having a securing mechanism receiving passageway extending there through, a fitting member extending from the device base; and a receiving chamber accessible through the securing mechanism receiving passageway and positioned within inner walls of the fitting member; and a measuring receptacle having a receptacle base, a side wall extending from an upper surface of the receptacle base, and a securing mechanism extending upward from the upper surface of the receptacle base and passing through the securing mechanism receiving passageway.

2. The bottle according to claim 1, wherein the securing mechanism is keyed to the securing mechanism receiving passageway and receiving chamber.

3. The bottle according to claim 1, wherein the securing mechanism is removably secured in the securing passageway of the fitting member.

4. The bottle according to claim 1, wherein the container further includes a body and a self supporting base structure connected to the body and having a projection extending from the body.

5. The bottle according to claim 4, wherein the projection includes a support, an exterior wall that extends from the body and connects to the support, and a recess extending inward from the support toward an inner compartment of the body.

6. The bottle according to claim 5, wherein the recess is a cavity shaped to receive the securing device.

7. The bottle according to claim 6, wherein the securing device is adapted to communicate with the recess such that the securing device is snug fit within the recess.

8. The bottle according to claim 7, wherein the securing device includes a base and a receiving passageway extending through the base and into the fitting member.

9. The bottle according to claim 8, wherein the receiving passageway is a slot extending through the base and into the fitting member.

10. The bottle according to claim 9, wherein the fitting member includes a receiving chamber within the fitting member and is accessible through the receiving passageway.

11. The bottle according to claim 10, wherein the fitting member further includes a retaining wall positioned adjacent to an opening of the receiving passageway.

12. The bottle according to claim 11, wherein the receiving chamber is shaped and sized to accommodate the securing mechanism.

13. The bottle according to claim 12, wherein the retaining wall is a floor of the receiving chamber.

14. The bottle according to claim 13, further comprising a vertical support wall that extends from the retaining wall.

15. The bottle according to claim 8, wherein the fitting member is an elongated member extending from the base and having the receiving passageway extend completely there through.

16. The bottle according to claim 15, wherein a top surface of the fitting member is a retaining wall.

17. The bottle according to claim 8, wherein the fitting member frictionally engages with the recess.

18. The bottle according to claim 17, wherein the fitting member elastically deforms to bias an inner wall of the recess.

* * * * *